US008454816B1

(12) United States Patent
Harrison et al.

(10) Patent No.: US 8,454,816 B1
(45) Date of Patent: Jun. 4, 2013

(54) SELECTIVE RECOVERY OF MANGANESE AND ZINC FROM GEOTHERMAL BRINES

(75) Inventors: Stephen Harrison, Benicia, CA (US); Samaresh Mohanta, San Diego, CA (US)

(73) Assignee: Simbol Inc., Pleasanton, CA (US)

( * ) Notice: Subject to any disclaimer, the term of this patent is extended or adjusted under 35 U.S.C. 154(b) by 325 days.

(21) Appl. No.: 12/880,924

(22) Filed: Sep. 13, 2010

Related U.S. Application Data

(60) Provisional application No. 61/241,479, filed on Sep. 11, 2009.

(51) Int. Cl.
*C25C 1/16* (2006.01)
*C25B 1/21* (2006.01)

(52) U.S. Cl.
USPC ..... 205/540; 205/539; 205/602; 205/608

(58) Field of Classification Search
USPC ..... 205/539–542, 602–608
See application file for complete search history.

(56) References Cited

U.S. PATENT DOCUMENTS

| | | | | |
|---|---|---|---|---|
| 4,016,075 | A * | 4/1977 | Wilkins | 210/712 |
| 4,116,856 | A | 9/1978 | Lee et al. | |
| 4,159,311 | A | 6/1979 | Lee et al. | |
| 4,221,767 | A | 9/1980 | Lee et al. | |
| 4,291,001 | A | 9/1981 | Repsher et al. | |
| 4,347,327 | A | 8/1982 | Lee et al. | |
| 4,348,295 | A | 9/1982 | Burba, III | |
| 4,348,296 | A | 9/1982 | Bauman et al. | |
| 4,348,297 | A | 9/1982 | Bauman et al. | |
| 4,376,100 | A | 3/1983 | Lee et al. | |
| 4,430,311 | A | 2/1984 | Lee et al. | |
| 4,461,714 | A | 7/1984 | Burba, III | |
| 4,472,362 | A | 9/1984 | Burba, III | |
| 4,540,509 | A | 9/1985 | Burba, III | |
| 4,727,167 | A | 2/1988 | Burba, III et al. | |
| 5,135,652 | A | 8/1992 | Boateng | |
| 5,254,225 | A * | 10/1993 | Gallup | 205/573 |
| 5,389,349 | A | 2/1995 | Bauman et al. | |
| 5,599,516 | A | 2/1997 | Bauman et al. | |
| 6,017,500 | A | 1/2000 | Mehta | |
| 6,280,693 | B1 | 8/2001 | Bauman et al. | |
| 6,458,184 | B2 | 10/2002 | Featherstone | |
| 6,555,078 | B1 | 4/2003 | Mehta | |
| 6,682,644 | B2 * | 1/2004 | Featherstone et al. | 205/539 |
| 2001/0000597 | A1 * | 5/2001 | Featherstone | 205/605 |
| 2003/0226761 | A1 | 12/2003 | Featherstone et al. | |

OTHER PUBLICATIONS

Cole et al., "Zinc Solvent Extraction in the Process Industries", 24(2) Mineral Proc. & Extractive Metallurgy Rev (2003), pp. 91-137.

(Continued)

*Primary Examiner* — Arun S Phasge
(74) *Attorney, Agent, or Firm* — Michael Samardzija; Bracewell & Giuliani LLP

(57) ABSTRACT

This invention relates to a method for the selective recovery of manganese and zinc from geothermal brines that includes the steps of removing silica and iron from the brine, oxidizing the manganese and zinc to form precipitates thereof, recovering the manganese and zinc precipitates, solubilizing the manganese and zinc precipitates, purifying the manganese and zinc, and forming a manganese precipitate, and recovering the zinc by electrochemical means.

20 Claims, 11 Drawing Sheets

OTHER PUBLICATIONS

Dreisinger et al., "New Developments in the Boleo Copper-Cobalt-Zinc-Manganese Project", available at http://bajamining.com/__resources/Reports/alta__paper__2006__boleo__final.pdf.

Gotfryd et al., "Recovery of Zinc(II) from Acidic Sulfate Solutions. Simulation of Counter-Current Extraction Stripping Process", 38 Physiochemical Problems of Mineral Processing (2004), pp. 113-120.

Kawai et al., "Solvent extraction of zinc(II) and manganese(II) with 5,10,15,20-tetraphenyl-21H, 23H-porphine(TPP) through the metal exchange reaction of lead(II)-TPP", 7 Solvent Extr. Res. Dev. Japan (2000), pp. 36-43.

Lee et al., "Solvent Extraction of Zinc from Strong Hydrochloric Acid Solution with Alamine 336", 30(7) Bull. Korean Chem. Soc. (2009), pp. 1526-1530.

U.S. Appl. No. 13/539,106, filed Jun. 29, 2012.

* cited by examiner

SELECTIVE RECOVERY OF MANGANESE AND ZINC FROM GEOTHERMAL BRINES

RELATED APPLICATIONS

This application claims priority to U.S. Provisional Patent Application Ser. No. 61/241,479, filed on Sep. 11, 2009, which is incorporated herein by reference in its entirety.

BACKGROUND OF THE INVENTION

1. Technical Field of the Invention

This invention generally relates to the field of selectively removing manganese and zinc from brines. More particularly, the invention relates to methods for the selective removal and recovery of manganese and zinc geothermal brines that include zinc and manganese, preferably without the simultaneous removal of other ions from the brines.

2. Description of the Prior Art

Geothermal brines are of particular interest for a variety of reasons. First, geothermal brines provide a source of power due to the fact that hot geothermal pools are stored at high pressure underground, which when released to atmospheric pressure, can provide a flash-steam. The flash-stream can be used, for example, to run a power plant. Additionally, geothermal brines contain useful elements, which can be recovered and utilized for secondary processes. With some geothermal waters and brines, binary processes can be used to heat a second fluid to provide steam for the generation of electricity without the flashing of the geothermal brine.

It is known that geothermal brines can include various metal ions, particularly alkali and alkaline earth metals, as well as silica, iron, lead, silver, zinc and manganese, in varying concentrations, depending upon the source of the brine. Recovery of these metals is potentially important to the chemical, pharmaceutical and electronics industries. Typically, the economic recovery of desired metals from natural brines, which may vary widely in composition, depends not only on the specific concentration of the desired metal, but also upon the concentrations of interfering ions, particularly silica, calcium and magnesium, because the presence of the interfering ions will increase recovery costs as additional steps must be taken to remove the interfering ions, before the desired metals are recovered.

One problem associated with geothermal brines when utilized for the production of electricity results from scaling and deposition of solids. Silica and other solids that are dissolved within the geothermal brine precipitate out during all stages of brine processing, particularly during the cooling of a geothermal brine, and may eventually result in fouling of the injection wells or processing equipment.

Although conventional processing of ores and brines currently employed can be used to recover a portion of the manganese and zinc present in geothermal brines, there still exists a need to develop economic methods that are selective for the removal and recovery of manganese and zinc from the brines at high yields and high purity.

SUMMARY OF THE INVENTION

Methods for the selective removal and recovery of manganese and zinc metals and compounds from geothermal brines are provided.

In a first embodiment, a method for recovering zinc and manganese ions from a geothermal brine is provided. The method includes the steps of: providing a geothermal brine that includes manganese and zinc ions; selectively removing silica and iron from the geothermal brine to produce a substantially silica free brine; adjusting the pH of the substantially silica free brine to a pH suitable to form precipitates of zinc and manganese as hydroxides and oxides, such that precipitates of zinc and manganese are selectively formed and other metal precipitates are not formed; separating the zinc and manganese precipitates from the brine; dissolving the precipitates of zinc and manganese to produce a zinc manganese solution; oxidizing the manganese to form a manganese precipitate and a zinc solution; separating the manganese precipitate from the zinc solution; and recovering the zinc by electrochemical means.

In a second embodiment, a method for recovering zinc and manganese from a geothermal brine is provided. The method includes the steps of providing a geothermal brine that includes manganese and zinc ions; selectively removing silica and iron from the geothermal brine to produce a substantially silica free brine that includes manganese and zinc; removing the zinc from the substantially silica free brine by means of an ion exchange or other process; extracting manganese from the substantially silica free brine; oxidizing the manganese to produce a manganese dioxide precipitate; and recovering the magnesium dioxide precipitate. In certain embodiments, the process can include the recycling of various solutions to dissolve manganese and zinc precipitates.

In a third embodiment, a method for recovering zinc and manganese from a geothermal brine is provided. The method includes the steps of: providing a geothermal brine that includes manganese and zinc; selectively removing silica and iron from the geothermal brine to produce a substantially silica free brine that includes manganese and zinc; extracting manganese and zinc from the substantially silica free brine to produce a manganese zinc solution; electrochemically removing manganese as manganese metal or manganese dioxide from the manganese zinc solution to produce a residual solution that includes zinc; and electrochemically removing zinc from the residual solution. In certain embodiments, the manganese dioxide and zinc can be recovered in a single electrochemical cell.

In a fourth embodiment of the invention, a method for recovering zinc and manganese from a geothermal brine is provided. The method includes the steps of: providing a geothermal brine that includes manganese and zinc; selectively removing silica and iron from the geothermal brine to produce a substantially silica free brine that includes manganese and zinc; adjusting the pH of the substantially silica free brine to a pH suitable to form precipitates of zinc and manganese, such that precipitates of zinc and manganese are selectively formed and other metal precipitates are not formed; separating the zinc and manganese precipitates from the brine; dissolving the precipitates of zinc and manganese to produce a zinc manganese solution; extracting zinc by solvent extraction; recovering and oxidizing the manganese to form a manganese dioxide precipitate and a zinc solution; separating the manganese precipitate from the zinc solution; and recovering the zinc by electrochemical means. In certain embodiments, the oxidation of the manganese is by chemical means. In alternate embodiments, the oxidation of manganese is by electrochemical means.

In a fifth embodiment of the invention, a method for recovering zinc and manganese from a geothermal brine is provided. The method includes the steps of: providing a geothermal brine that includes manganese and zinc; selectively removing silica and iron from the geothermal brine to produce a substantially silica free brine that includes manganese and zinc; adjusting the pH of the substantially silica free brine to a pH suitable to form precipitates of zinc and manganese, such that precipitates of zinc and manganese are selectively formed and other metal precipitates are not formed; separating the zinc and manganese precipitates from the brine; dissolving the precipitates of zinc and manganese to produce a zinc manganese solution; extracting manganese by solvent extraction and then recovering manganese; recovering and oxidizing the dissolved manganese to form a manganese dioxide precipitate and a zinc solution; and recovering the zinc by electrochemical means. In certain embodiments, the recovery of manganese is by oxidation of the manganese is by chemical means. In alternate embodiments, the oxidation of manganese is by electrochemical means. In further embodiments, manganese is recovered by electrochemical reduction.

In a sixth embodiment of the invention, a method for recovering zinc and manganese from a geothermal brine is provided. The method includes the steps of providing a geothermal brine that includes manganese and zinc; selectively removing silica and iron from the geothermal brine to produce a substantially silica free brine that includes manganese and zinc; adjusting the pH of the substantially silica free brine to a pH suitable to form precipitates of zinc and manganese, such that precipitates of zinc and manganese are selectively formed and other metal precipitates are not formed; separating the zinc and manganese precipitates from the brine; dissolving the precipitates of zinc and manganese to produce a zinc manganese solution; extracting by way of a double solvent extraction both zinc and manganese in two separate streams; recovering and oxidizing the dissolved manganese to form a manganese dioxide precipitate and a zinc solution; and recovering the zinc by electrochemical means. In certain embodiments, the oxidation of the manganese is by chemical means. In alternate embodiments, the oxidation of manganese is by electrochemical means.

In a seventh embodiment of the invention, a method for recovering zinc and manganese from a geothermal brine is provided. The method includes the steps of providing a geothermal brine that includes manganese and zinc; selectively removing silica and iron from the geothermal brine to produce a substantially silica free brine that includes manganese and zinc; adjusting the pH of the substantially silica free brine to a pH suitable to form precipitates of zinc and manganese as hydroxides and oxides, such that precipitates of zinc and manganese are selectively formed and other metal precipitates are not formed; separating the zinc and manganese precipitates from the brine; dissolving the precipitates of zinc and manganese to produce a zinc manganese solution; extracting by way of a double solvent extraction both zinc and manganese in two separate streams; recovering and reducing the dissolved manganese to form a manganese metal electrolytically and a zinc solution; and recovering the zinc by electrochemical means.

In an eighth embodiment of the invention, a method for recovering zinc and manganese from a geothermal brine is provided. The method includes the steps of: providing a geothermal brine that includes manganese and zinc; selectively removing silica and iron from the geothermal brine to produce a substantially silica free brine that includes manganese and zinc; adjusting the pH of the substantially silica free brine to a pH suitable to form precipitates of zinc and manganese, such that precipitates of zinc and manganese are selectively formed and other metal precipitates are not formed; separating the zinc and manganese precipitates from the brine; dissolving the precipitates of zinc and manganese to produce a zinc manganese solution; extracting by way of a double solvent extraction both zinc and manganese in two separate streams; reacting the manganese stream to produce a manganese salt; and reacting the zinc stream to produce a zinc salt. In certain embodiments, the manganese salt is selected from manganese carbonate, manganese sulfate, and a manganese halide. In certain embodiments, the zinc salt is selected from zinc carbonate, zinc sulfate, or a zinc halide.

In a ninth embodiment of the invention, a method for recovering zinc and manganese from a geothermal brine is provided. The method includes the steps of providing a geothermal brine that includes manganese and zinc; selectively removing silica and iron from the geothermal brine to produce a substantially silica free brine that includes manganese and zinc; recovering zinc by contacting the substantially silica free brine with an ion exchange resin, and recovering manganese from the solution by electrolytically depositing manganese dioxide from the substantially silica free brine. Optionally, following removal of the zinc and manganese, the remaining brine solution can be recycled to the step for recovering zinc by contacting with the ion exchange resin. In an alternate embodiment, the ion exchange resin is a basic anionic exchange resin.

In a tenth embodiment, a method for recovering zinc and manganese from a geothermal brine is provided. The method includes the steps of: providing a geothermal brine that includes manganese and zinc; selectively removing silica and iron from the geothermal brine to produce a substantially silica free brine that includes manganese and zinc. The method includes adjusting the pH of the substantially silica free brine to a pH suitable to form precipitates of zinc and manganese, such that precipitates of zinc and manganese are selectively formed and other metal precipitates are not formed, and separating the manganese and zinc precipitates from the brine. The method further includes dissolving the precipitates of zinc and manganese in an acid to produce a zinc and manganese containing acid solution and extracting the zinc and manganese containing acid solution with an extraction solvent to produce a first liquid phase that includes the extraction solvent and zinc and a second liquid phase that includes manganese. The first and second liquid phases are separated and then zinc is electrochemically recovered from the first liquid phase. The second liquid phase is reduced to form $Mn^{2+}$ and the second liquid phase is supplied to an electrochemical cell and manganese is recovered by electrochemical means.

In an eleventh embodiment, a method for recovering zinc and manganese from a geothermal brine is provided. The method includes the steps of providing a geothermal brine that includes manganese and zinc; selectively removing silica and iron from the geothermal brine to produce a substantially silica free brine that includes manganese and zinc. The method includes adjusting the pH of the substantially silica free brine to a pH suitable to form precipitates of zinc and manganese, such that precipitates of zinc and manganese are selectively formed and other metal precipitates are not formed, and separating the manganese and zinc precipitates from the brine. The method further includes dissolving the precipitates of zinc and manganese in ammonium sulfate to produce a zinc and manganese containing ammonium sulfate solution and extracting the zinc and manganese containing ammonium sulfate solution with an extraction solvent to produce a first liquid phase that includes the extraction solvent and zinc and a second liquid phase that includes manganese and ammonium sulfate. The first and second liquid phases are separated and then zinc is electrochemically recovered from the first liquid phase. The second liquid phase is reduced to form $Mn^{2+}$ and the second liquid phase is supplied to an electrochemical cell and manganese is recovered by electrochemical means.

DETAILED DESCRIPTION OF THE INVENTION

Broadly, described herein are methods for the selective removal of manganese and zinc from solution. As used herein, the selective removal of manganese and zinc generally refers to methods to facilitate the removal of manganese and zinc from solutions that include manganese and zinc, such as geothermal brines, without the removal of other ions. Generally, in certain embodiments, the methods employ chemical means for the separation of manganese and zinc from brines. In certain embodiments, the methods may include physical means, as well as chemical means, for the separation of manganese and zinc from brines.

As used herein, "brine" or "brine solution" refers to any aqueous solution that contains a substantial amount of dissolved metals, such as alkali and/or alkaline earth metal salt(s) in water, wherein the concentration of salts can vary from trace amounts up to the point of saturation. As used herein, brine refers to both geothermal brines and waste or byproduct streams from industrial processes.

Generally, brines suitable for the methods described herein are aqueous solutions that may include alkali metal or alkaline earth chlorides, bromides, sulfates, hydroxides, nitrates, and the like, as well as natural brines. In certain brines, metals may be present. Exemplary elements present in the geothermal brines can include sodium, potassium, calcium, magnesium, lithium, strontium, barium, iron, boron, silica, manganese, chlorine, zinc, aluminum, antimony, chromium, cobalt, copper, lead, arsenic, mercury, molybdenum, nickel, silver, thallium, vanadium, and fluorine, although it is understood that other elements and compounds may also be present. Brines can be obtained from natural sources, such as, Chilean brines or Salton Sea brines, geothermal brines, sea water, mineral brines (e.g., lithium chloride or potassium chloride brines), alkali metal salt brines, and industrial brines, for example, industrial brines recovered from ore leaching, mineral dressing, and the like. The method is also equally applicable to artificially prepared brine or salt solutions.

Figure 1:
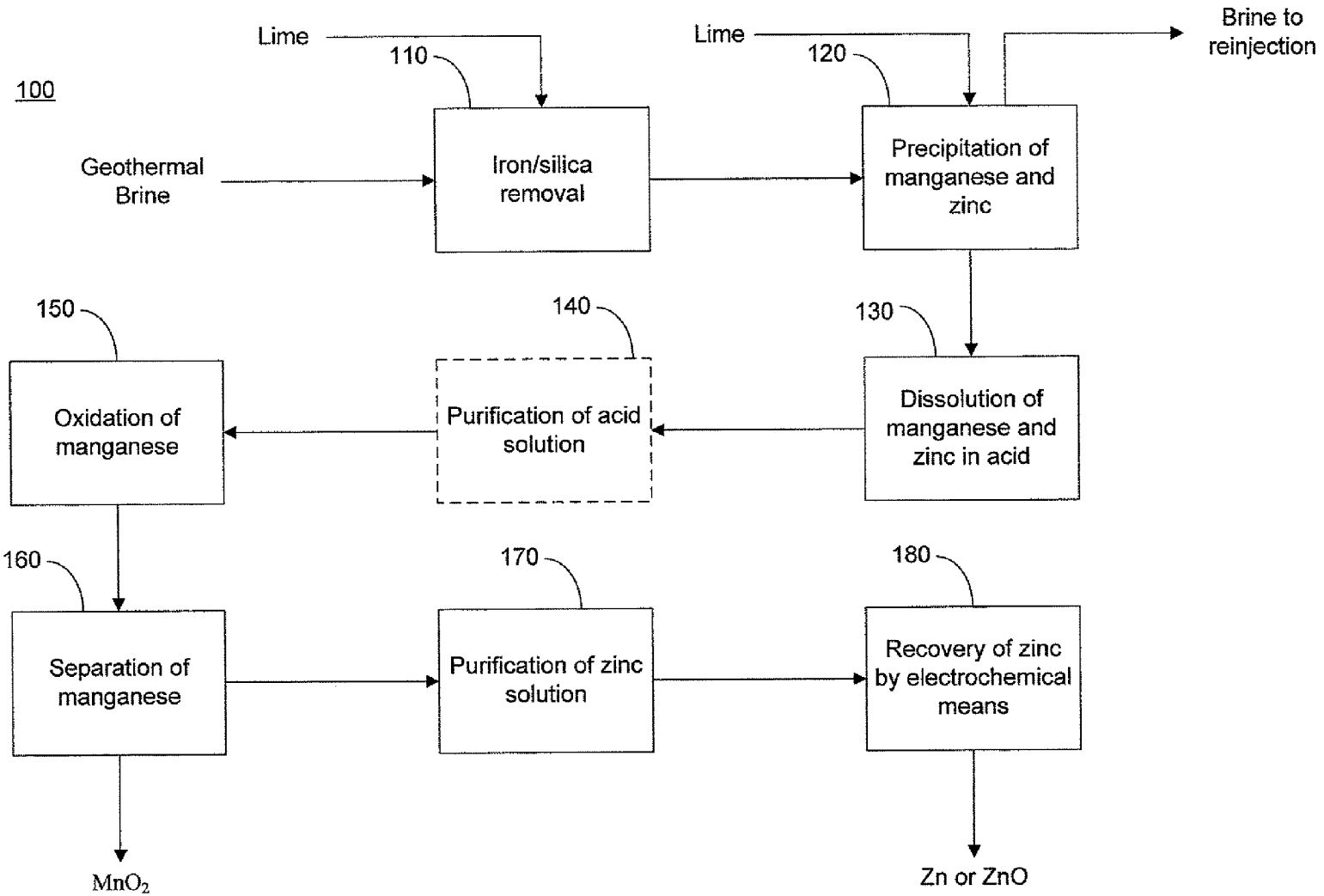
FIG. 1 illustrates a process for the recovery of manganese and zinc from a geothermal brine according to one embodiment of the invention.

As shown in FIG. 1, process 100 of the present invention first removes silica and iron from the brine solution in an iron/silica removal step 110. In certain embodiments, the iron and silica removal step preferably removes only the iron and silica, while at the same time leaving all other metals and/or ions present in the brine undisturbed. The removal of silica is an important step as the presence of silica can interfere with subsequent processes for the recovery of various other metals. For example, silica frequently clogs pores in filtration media.

One preferred method for the selective removal of silica and iron includes contacting the solution with iron (III) hydroxide at a pH of between about 4.5 and 6, preferably between about 4.75 and 5.5, more preferably between about 4.9 and 5.3.

Typically, brine will have an iron (II) salt present naturally. In other embodiments, an iron (II) salt or iron (III) hydroxide can be added to the brine to achieve a certain concentration of iron (II) salt or iron (III) hydroxide relative to the silica or silicon containing compounds present in the brine. In certain embodiments, the molar ratio of the iron (II) salt or iron (III) hydroxide to silica is at least 1:1, preferably at least 4:1, more preferably at least 7:1 and even more preferably at least 10:1.

When the iron in the brine or silica containing solution is iron (II), for example iron (II) chloride, an oxidant is added to oxidize iron (II) salt to iron (III) hydroxide. The preferred oxidant is air. Thus, in one preferred embodiment, the iron (II) salt present in the brine can be oxidized to iron (III) by sparging the reaction vessel with air. While it is understood that many different oxidants can be used for the oxidation of iron (II) to iron (III), the use of oxygen or air as the oxidant in the pH range of between 4 and 7 is selective for the oxidation of the iron (II) salt to iron (III) hydroxide, and generally does not result in the precipitation or oxidation of other elements or compounds that are present in the brine. Control of the pH of the solution can be achieved with the addition of base (e.g., calcium hydroxide, calcium oxide or the like). As noted previously, it is preferred that the pH is maintained between 4.5 and 6.

Other exemplary oxidants can include hypohalite compounds, such as hypochlorite, hydrogen peroxide (in the presence of an acid), air, halogens, chlorine dioxide, chlorite, chlorate, perchlorate and other analogous halogen compounds, permanganate salts, chromium compounds, such as chromic and dichromic acids, chromium trioxide, pyridinium chlorochromate (PCC), chromate and dichromate compounds, sulfoxides, persulfuric acid, nitric acid, ozone, and the like. It will be recognized by those skilled in the art that iron (III) hydroxide may also have a significant affinity for arsenic (III) and (V) oxyanions, and these anions, if present in the brine, may be co-deposited with the silica on the iron (III) hydroxide.

In another embodiment, iron (III) hydroxide can be produced by adding a solution of iron (III) chloride to the brine, which on contact with the more neutral brine solution, will precipitate as iron (III) hydroxide. The brine may require neutralization, such as through the addition of base to initiate precipitation of the iron (III) hydroxide.

The iron (III) hydroxide contacts the silica present in the brine and forms a precipitate. Without being bound to any specific theory, it is believed that the silica or silicon containing compound attaches to the iron (III) hydroxide. In certain embodiments, the ratio of iron (III) to silica is at least about 1:1, more preferably at least about 4:1. The reaction of the iron (III) hydroxide with silica is capable of removing at least about 80% of the silica present, preferably at least about 90%, and more preferably at least about 95%, and typically depends upon the amount of iron (III) hydroxide present in the solution.

In certain embodiments, the iron (II) salt containing solution can be sparged with air for a period of at least 15 min., preferably at least 30 min., followed by the addition of a base, such as calcium oxide, calcium hydroxide, sodium hydroxide, or the like, to achieve the desired pH for the solution.

After silica and iron removal step 110, in precipitation step 120, a base (e.g., calcium oxide, calcium hydroxide or the like) is added to the brine to adjust or maintain a pH of the brine at greater than at least about 6, preferably between about 6 and 8.5, more preferably between about 6.5 and 8. In alternate embodiments, the pH is maintained at about 7. In certain embodiments, the pH is maintained at less than about 9. The base may be in solution or slurry form. Furthermore, the solution is exposed to an oxygen source and manganese and zinc precipitates are formed. In certain embodiments, depending upon the pH of the solution, a lead precipitate may also be formed. To achieve oxidation of the manganese, air is preferably supplied to the solution by sparging or bubbling. Other oxidants suitable for the oxidation of the manganese can include hypohalites, hydrogen peroxide, and ozone.

The solids in the brine and base, which solids can include at least manganese and zinc, are separated from the remainder of the mixture, which retains the majority of ions present in the brine. Separation of the solids can be done by conventional filtration means and can optionally include centrifugation or other known techniques for concentration the solids. In certain embodiments, the remaining brine solution from which the manganese and zinc have been removed can then be reinjected into the geothermal well from which the brine was originally removed.

The manganese and zinc solids that are separated from the remaining brine solution can then be dissolved in an acid solution in step 130. Preferred acids include strong mineral acids, such as hydrochloric acid, sulfuric acid, methanesulfonic acid, and the like. In certain embodiments, lead and/or calcium precipitates may be formed during the precipitation of the manganese and zinc. In these embodiments, the selected acid is preferably sulfuric acid, as sulfuric acid is selective for manganese and zinc precipitates, and does not dissolve the lead and/or calcium precipitates that may be present. The acid is preferably added to the solids in greater than approximately a 1:1 molar ratio to the solids. In certain embodiments, it may be beneficial to minimize the amount of excess acid that is utilized for dissolving the manganese and zinc precipitates, for ease of performance of downstream processes, as well as for economic and environmental considerations. In certain embodiments, the solids and acid are mixed to ensure complete dissolution of the solids.

The acid and dissolved metal solution is then filtered to remove remaining solids, if any, and the solution may then be purified in optional purification step 140 to remove trace metals, which may be present in the acidified solution. It is believed that metals, such as copper, cadmium, nickel, antimony and/or cobalt, as well as other metals or ions, may be present in trace amounts in the acid and dissolved metal solution. These trace metals may interfere with the subsequent separation of manganese and zinc. Purification of the acid and dissolved metal solution can be achieved by known means, such as ion exchange or by treatment with zinc dust. Zinc dust operates by first displacing other more noble metals from solution and allowing them to precipitate on undissolved zinc dust. For example, copper ions present in the solution will precipitate as copper metal or will deposit on undissolved zinc dust.

Manganese and zinc can be extracted from the acid and dissolved metal solution using solvent extraction techniques. Suitable solvents for the extraction of manganese and zinc include phosphines, phosphoric acids, and phosphinic acids, such as the following: di(2-ethylhexyl)phosphoric acid (DEHPA) in kerosene or Cyanex® 272 (bis(2,4,4-trimethylpentyl)phosphinic acid); lonquest 290 (available form Rhodia Inc.) in aliphatic kerosene or the highly branched carboxylic acid extractant (versatic 10)(10-decyl-4-pyridinecarboxylate). In certain embodiments, DEHPA is a suitable extraction solvent, particularly in embodiments where iron has been previously removed.

Other exemplary solvents that may be used for the extraction of zinc are discussed in U.S. Pat. No. 5,135,652, the disclosure of which is herein incorporated by reference in its entirety. These exemplary solvents include mono-2-ethylhexylphosphoric acid (M2EHPA), di-2-ethylhexylphosphoric acid (D2EHPA), and mixtures thereof (EHPA). Other exemplary solvents include bis-2,4,4-trimethylpentylmonothiophosphinic acid (Cyanex® 302) and bis-2,4,4-trimethylpentyldithiophosphinic acid (Cyanex® 301). In certain embodiments, the extractant includes both phosphoric acid and phosphinic acid. In certain embodiments, the ratio of phosphoric acid to phosphinic acid is greater than about 1:1, preferably between about 1:1 and 1:6. In certain embodiments, the extractant can be diluted with a hydrocarbon solvent, preferably a dearomatized aliphatic hydrocarbon. Exemplary diluents include Exxsol™ D80.

The pH during the extraction is maintained at less than about 7, preferably between about 1 and 5, more preferably in the range of about 1.5 to 3.5.

Other solvents suitable for the extraction of zinc from brine solutions are described in "Recovery of Zinc(II) from Acidic Sulfate Solutions. Simulation of Counter-Current Extraction Stripping Process", Gotfryd, L. and Szymanowski, J.; Physicochemical Problems of Mineral Processing, vol. 38 (2004), pp. 113-120; "New Developments in the Boleo Copper-Cobalt-Zinc-Manganese Project", Dreisinger, et al.; available at http://bajamining.com/_resources/Reports/alta_paper_2006 boleo_final.pdf; "Zinc Solvent Extraction in the Process Industries", Cole, P. and Sole, K.; Mineral Processing and Extractive Metallurgy Review, vol. 24, no. 2 (2003), pp. 91-137; "Solvent extraction of zinc(II) and manganese(II) with 5,10,15,20-tetraphenyl-21H,23H-porphine(TPP) through the metal exchange reaction of lead(II)-TPP", Kawai, T., Fujiyoshi, R., and Sawamura, S.; Solvent Extr. Res. Dev. Japan, vol. 7 (2000), pp. 36-43, "Solvent Extraction of Zinc from Strong Hydrochloric Acid Solution with Alamine-336", Lee, M. and Nam, S.; Bull. Korean Chem. Soc., vol. 30, no. 7 (2009), pp. 1526-1530, the disclosures of which are incorporated herein by reference.

Manganese can be isolated by electrolysis or, in step 150, by oxidation to produce manganese dioxide, or by precipitation as a carbonate by reaction with sodium carbonate. In certain preferred embodiments, manganese can be selectively isolated from zinc as manganese dioxide by electrolysis in a sulfate solution, at an anode made of metals, such as titanium or carbon. Alternatively, selective oxidation of manganese to manganese dioxide can be achieved utilizing an oxidant, such as chlorine, hydrogen peroxide, or the like to provide solid manganese dioxide and zinc containing solution. In step 160, precipitated manganese dioxide is separated from the zinc containing solution by known means, such as filtration, centrifugation, or a like process.

In an alternate embodiments, manganese dioxide can be generated at the anode of a divided electrochemical cell by the oxidation of manganese (II) and manganese (II) to generate a manganese dioxide deposited on the surface of the electrode. After the solution is passed through anode compartment, it is then fed to the cathode compartment where zinc metal is electrodeposited. The current density ranges from between about 50 to about 500 $A/m^2$. The separator, such as an ion exchange membrane or a porous material that allows the passage of liquids, positioned between the anode and cathode assists in preventing deposition of manganese dioxide on the zinc metal. In certain embodiments, the separator can include a series of baffles. In certain embodiments, it may be advantageous to remove solid manganese dioxide from the electrolytic stream formed in the anode compartment that may be lost from the surface of the anode, such as by filtration, prior to supplying to the cathode compartment. Production of manganese dioxide by electrochemical means and the recovery of zinc metal by electrowinning preferably includes a conductive solution, such as sulfate, chloride, methanesulfonate, or the like, for improved efficiency. In certain embodiments, it is preferred that the electrochemical cell includes a small amount of free acid in the solution. In alternate embodiments, the electrochemical cell can be operated at a pH ranging from about 0 to 2. Following recovery of the manganese and zinc, the respective solutions can be recycled to the solvent extraction step. Alternatively, the respective solutions can be recycled to the acid solution.

The zinc containing solution can then be optionally purified in step 170 and then supplied to an electrochemical cell for electrochemical recovery in step 180 by electrowinning (also known as electroextraction). Electrowinning utilizes an electrochemical cell wherein a current is passed from an inert anode, such as lead dioxide, iridium dioxide coated titanium, or other stable substrate, through the zinc containing solution, leading to deposition of the zinc on the cathode. The base cathode can be aluminum, although other metals, such as steel, stainless steel, and titanium, can also be used. The cathode material is selected based upon chemical stability, electrical conductivity, and the ease of removal of zinc from substrate.

Alternatively, in the process illustrated by FIG. 1, the steps for the isolation and recovery of manganese and zinc can be reversed, i.e., the zinc can be separated and isolated from a solution that includes zinc and manganese by electrowinning, followed by the isolation of manganese by either electrowinning or oxidation of the manganese to produce manganese dioxide.

Optionally, the process may include a step for the recovery of lithium from the geothermal brine. Methods for the recovery are known in the art, such as is described in U.S. Pat. Nos. 4,116,856; 4,116,858; 4,159,311; 4,221,767; 4,291,001; 4,347,327; 4,348,295; 4,348,296; 4,348,297; 4,376,100; 4,430,311; 4,461,714; 4,472,362; 4,540,509; 4,727,167; 5,389,349; 5,599,516; 6,017,500; 6,280,693; and 6,555,078, each of which is incorporated herein by reference in their entirety. Alternatively, methods can be employed utilizing a lithium aluminate intercalate/gibbsite composite material, a resin based lithium aluminate intercalate, add/or a granulated lithium aluminate intercalate. The gibbsite composite is a lithium aluminate intercalate that is grown onto an aluminum trihidrate core. The resin-based lithium aluminate intercalate is formed within the pores of a macroreticular ion exchange resin. The granulated lithium aluminate intercalate consists of fine-grained lithium aluminate intercalate produced by the incorporation of a small amount of inorganic polymer. The process of contacting the lithium aluminate intercalate material with the geothermal brine is typically carried out in a column that includes the extraction material. The geothermal brine is flowed into the column and lithium ions are captured on the extraction material, while the water and other ions pass through the column. After the column is saturated, the captured lithium is removed by flowing water having a small amount of lithium chloride present through the column. In preferred embodiments, multiple columns are employed for the capture of the lithium.

Figure 2:
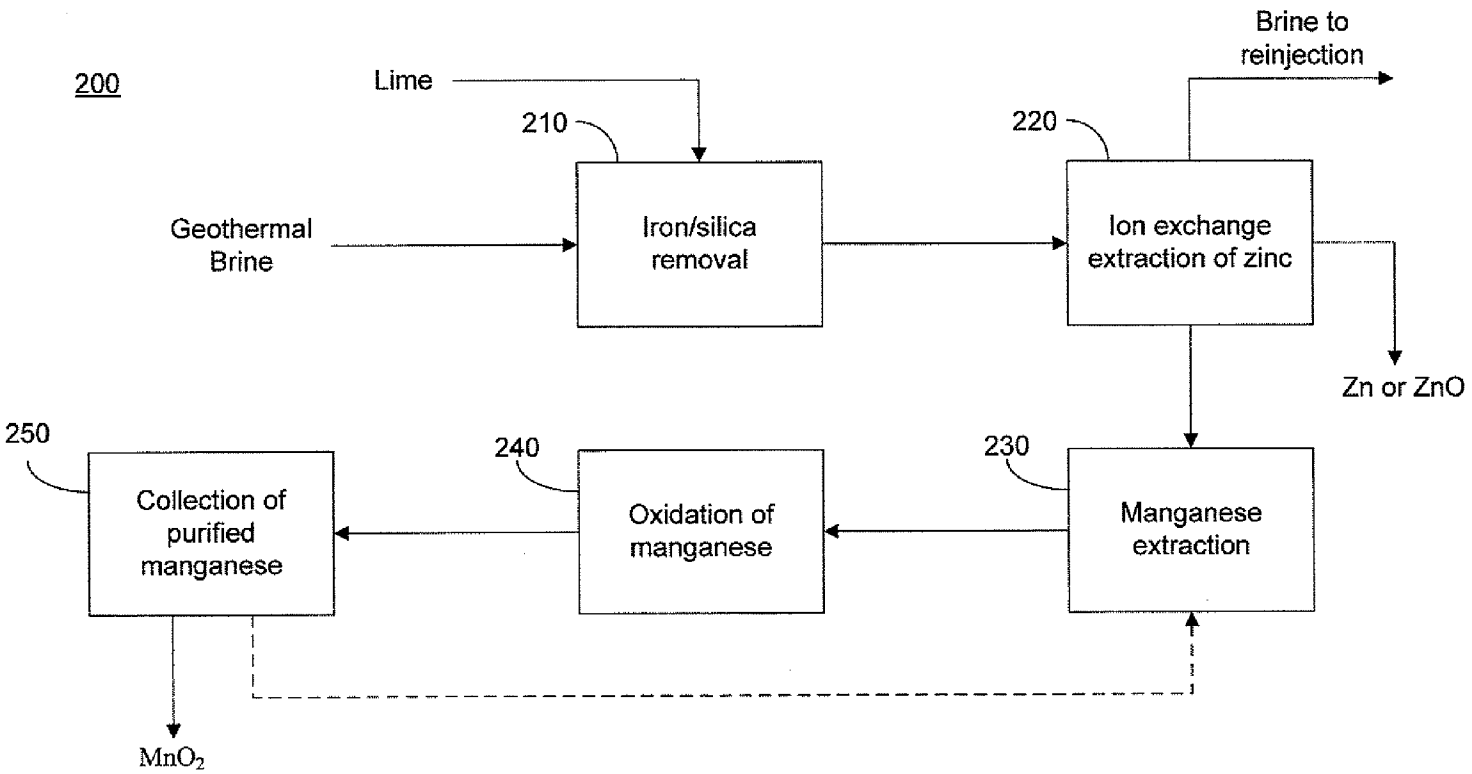
FIG. 2 illustrates another process for the recovery of manganese and zinc from a geothermal brine according to another embodiment of the invention.

In another embodiment of the present invention, in process 200 provided in FIG. 2, iron and silica are first removed from the geothermal brine in step 210. Methods for the removal of silica and iron include those methods previously described with respect to FIG. 1, and preferably include oxidation of the iron from iron (H) to iron (III), and the control of the pH of the solution with the addition of a base. Preferably, the iron is oxidized with air, and the pH is controlled by the addition of a base, such as calcium oxide or calcium hydroxide, or like compound.

The brine solution, now having a reduced concentration of silica and iron relative to the initial brine feed, can be supplied to zinc removal process 220 that can include an ion exchange process, for example a basic anionic ion exchange resin like the chloride of a quaternary amine divinylbenzene/stryrene copolymer, or the chloride of trimethylamine functionalized chloromethylated copolymer of styrene and divinylbenzene, such as is described in U.S. Pat. No. 6,458,184, which is incorporated herein by reference in its entirety. Zinc separated by ion exchange, existing as zinc chloride or a zinc chloride anions, can then be converted into a saleable zinc product, such as zinc metal or zinc oxide. In certain embodiments, the remaining brine solution from which the manganese and zinc have been removed can then be reinjected into the geothermal well from which the brine was originally removed.

The remaining solution, which includes manganese, can then optionally be supplied to purification step 230 and purified by ion exchange, solvent extraction, or like process, and the manganese containing phase can be provided to oxidation step 240, such as an electrochemical cell or chemical oxidation process, as described with respect to FIG. 1, to facilitate the recovery of manganese dioxide. Purified manganese can be collected in step 250 by filtration. As shown with the dashed line, the liquid phase from step 250 can optionally be recycled to manganese extraction step 230. As previously discussed, following recovery of the manganese and zinc, the respective solutions can be recycled to the solvent extraction step. Alternatively, the respective solutions can be recycled to the acid solution.

As noted with respect to FIG. 1, in process 200 the lithium can optionally be removed from the brine solution at any point during the process by the means discussed above.

Figure 3:
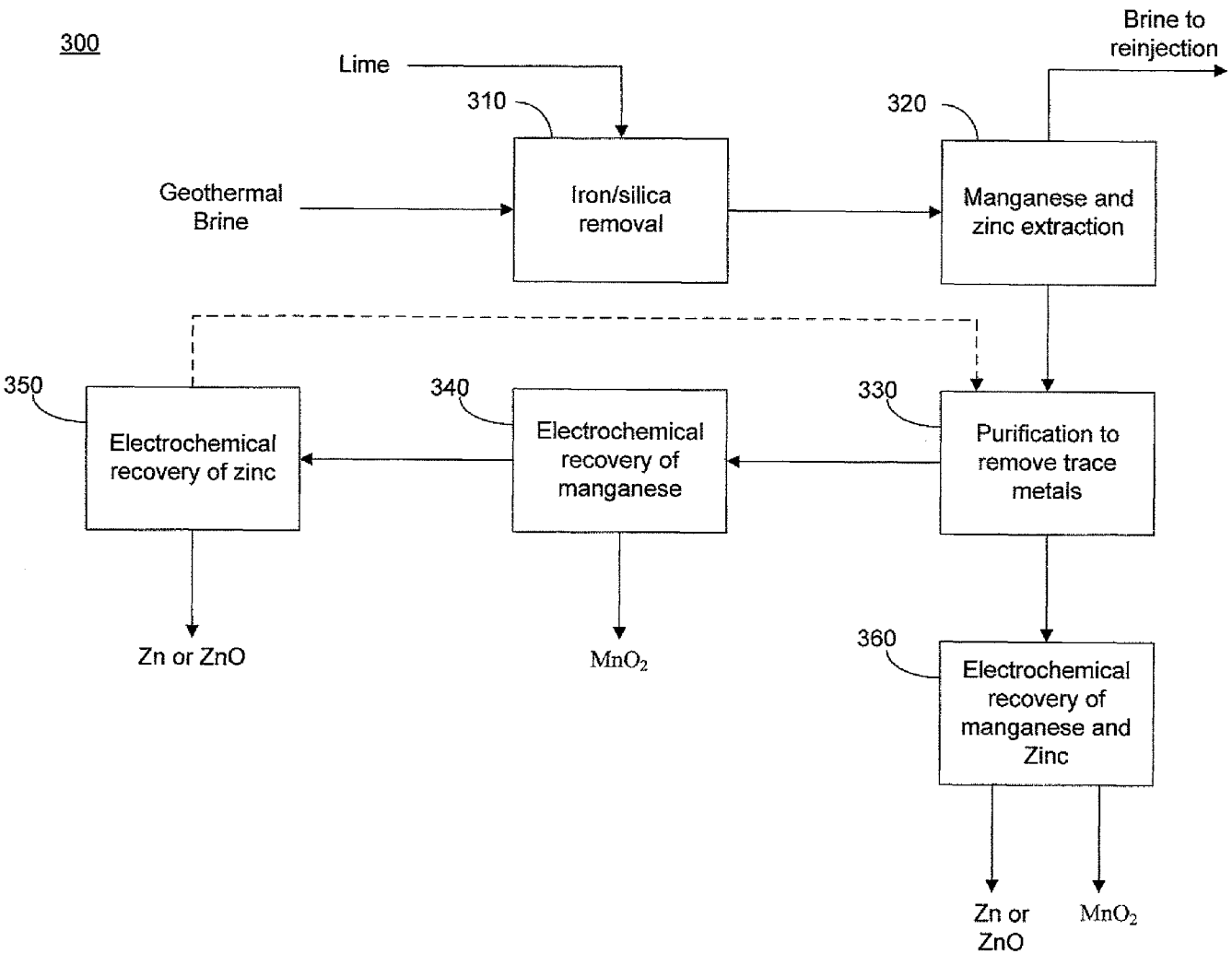
FIG. 3 illustrates another process for the recovery of manganese and zinc from a geothermal brine according to another embodiment of the invention.

In yet another embodiment, in process 300 shown in FIG. 3, a method for the separation and isolation of manganese and zinc from a brine is provided. As noted with respect to FIGS. 1 and 2, the first step of the process includes the removal of iron and silica from the brine solution in step 310. Preferably, as discussed above, the iron is oxidized and base is added to the solution to control the pH. Preferably, iron is oxidized with air, and the base is calcium oxide, calcium hydroxide, or a like compound.

Following removal of a major portion of the silica and iron, the manganese and zinc can be removed by liquid-liquid extraction step 320. Exemplary liquids suitable for the extraction of manganese and zinc are described in U.S. Pat. No. 6,458,184 and U.S. Pub. Pat. App. No, 20030226761, the disclosures of which are incorporated herein by reference in their entirety. The solvents can include, for example, water-immiscible cationic organic solvents, such as di-(2-ethylhexyl)phosphoric acid (D2EHPA), and other similar solvents, as known in the art. In certain embodiments, the remaining brine solution from extraction step 320, from which the manganese and zinc have been removed, can then be reinjected into the geothermal well from which the brine was originally removed.

Following the liquid-liquid extraction step, the extraction solution that includes the manganese and zinc can be provided to one or more purification steps 330. Purification steps 330 preferably operable to remove calcium and other divalent cations, as well as some metals, such as copper, cadmium, cobalt, molybdenum, and nickel, although the purification steps are not limited to these metals.

Following purification step 330, the manganese and zinc can be isolated in steps 340 and 350, respectively. Specifically, as previously discussed, manganese dioxide and zinc can each separately be produced from solution by electrowinning. In one embodiment, zinc is recovered first, followed by manganese. In an alternate embodiment, manganese is recovered first, followed by zinc. In certain embodiments, the pH is maintained at less than about 3.5 during the electrowinning process. In alternate embodiments, the temperature is maintained at less than about 60° C. during the electrowinning process. In certain embodiments, the pH of the solution supplied to manganese electrochemical recovery step 340 is about 5, and the pH of the solution exiting the electrochemical cell is about 1. The pH of the solution supplied to zinc electrochemical recovery step 350 is about 1.

In an alternate embodiment, the solution from purification step 330 can be supplied to a single electrochemical recovery step 360 wherein zinc and manganese can be deposited simultaneously as zinc oxide and manganese dioxide.

As previously discussed, following recovery of the manganese and zinc, the respective solutions can be recycled to either the solvent extraction step or to the acid solution. In certain embodiments, as shown by the dashed line, the solution from zinc electrochemical recovery step 350 can be recycled to purification step 330.

Figure 4:
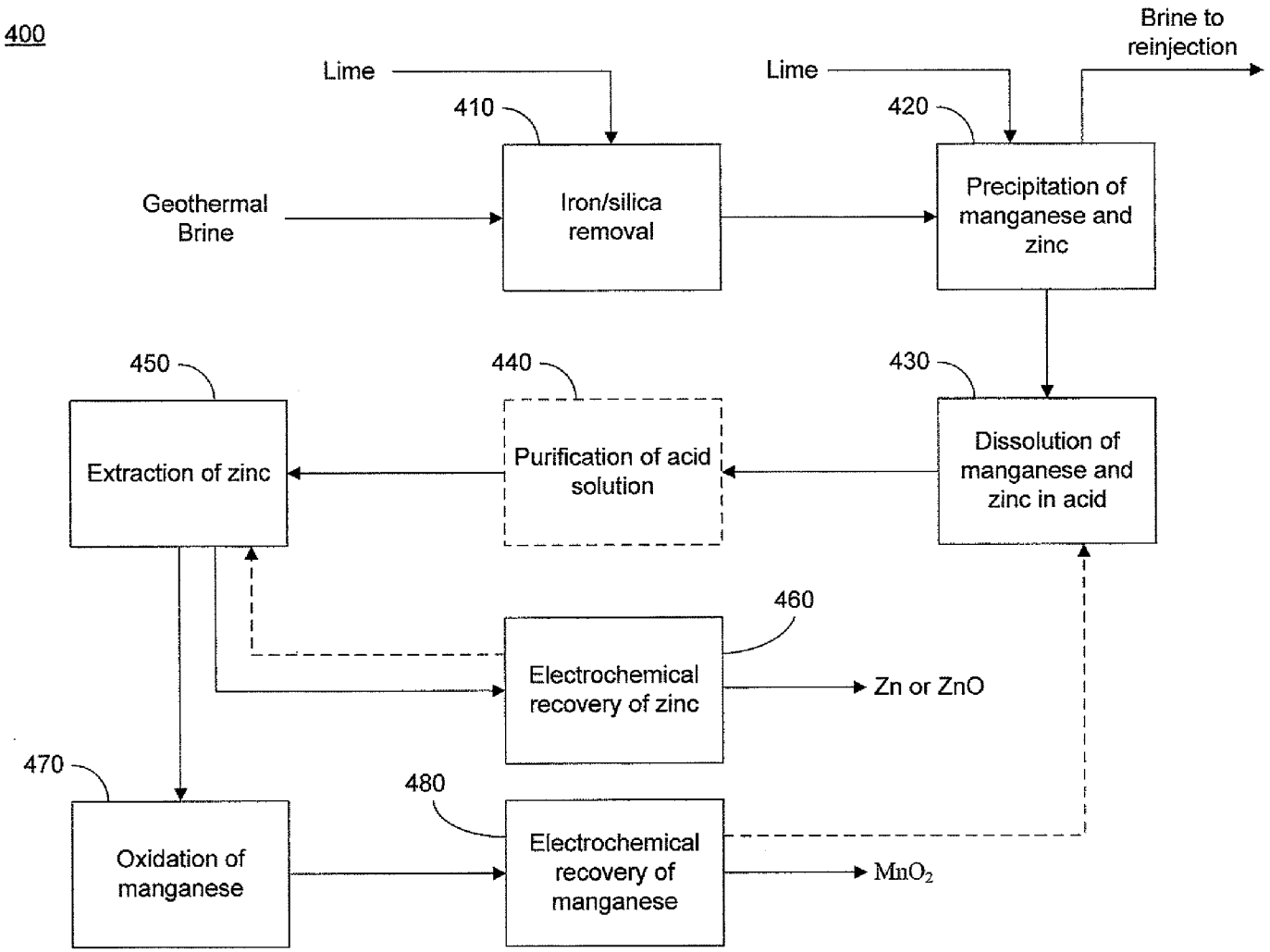
FIG. 4 illustrates another process for the recovery of manganese and zinc from a geothermal brine according to another embodiment of the invention.

In another embodiment, as provided in FIG. 4, process 400 for the recovery of manganese or zinc from a geothermal brine is provided. As previously discussed, with respect to FIG. 1, first step 410 of process 400 includes the removal of iron and silica from the brine solution. In certain embodiments, the iron is oxidized and base is added to control the pH of the solution. In certain embodiments, iron is oxidized with air and the base is calcium oxide or calcium hydroxide, or like compound.

Following the removal of the iron and silica, in precipitation step 420, additional base, such as lime, slaked lime, limestone, sodium hydroxide, and the like, is added to achieve a pH of between about 6 and 9, preferably up to about 8 when sparged with air, or up to about 9 when it is not sparged with air, to facilitate the precipitation of manganese and zinc. The manganese and zinc precipitates are collected by known means and dissolved in an acid solution in step 430, as previously discussed herein. In certain embodiments, the remaining brine solution from extraction step 420, from which the manganese and zinc have been removed, can then be reinjected into the geothermal well from which the brine was originally removed.

Optionally, the acid solution, which includes the manganese and zinc, can be purified in step 440, to remove trace metal impurities, such as heavy metals, for example, cobalt, copper, cadmium, nickel, and the like. The acid solution is then extracted in step 450 to recover zinc, as previously provided. Thus, following extraction, a first solution, which includes zinc and the extraction solvent, is produced and a second solution, which includes manganese, is produced.

The zinc can then be recovered by electrochemical means in step 460, such as by electrowinning or a like process, as previously discussed. Manganese can be recovered by first oxidizing the manganese in step 470 to produce manganese dioxide, as previously discussed, which can then be recovered electrochemically in step 480 by known means. As previously discussed, as shown by the dashed lines, following recovery of the manganese and zinc, the solutions from steps 460 and 480 can be recycled to solvent extraction step 450 or to the acid solution of dissolution step 430, respectively.

Figure 5:
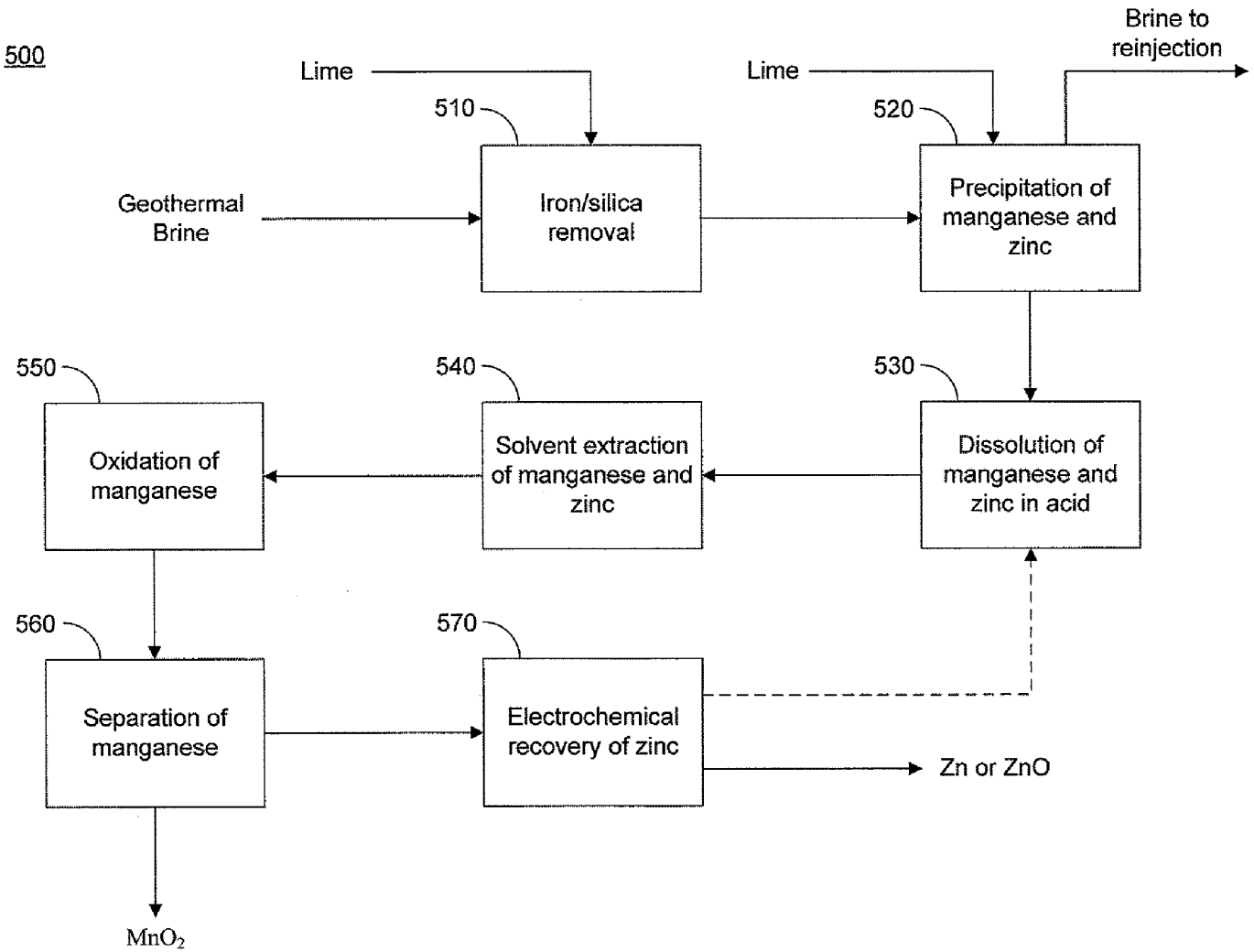
FIG. 5 illustrates another process for the recovery of manganese and zinc from a geothermal brine according to another embodiment of the invention.

In another embodiment, as provided in FIG. 5, process 500 for the recovery of manganese or zinc from a geothermal brine is provided. As previously discussed, first step 510 of the process includes the removal of iron and silica from the brine solution. In certain embodiments, the iron is oxidized and base is added to control the pH of the solution. In certain embodiments, iron is oxidized with air and the base is calcium oxide or calcium hydroxide.

Following the removal of the iron and silica, in precipitation step 520, additional base to adjust the pH to at least about 6 is added to facilitate the precipitation of manganese and zinc. The manganese and zinc precipitates are collected by known means, such as by filtration, centrifugation, or a like process, and dissolved in an acid solution in step 530, as previously discussed herein. Optionally, the acid solution, which includes the manganese and zinc, can be purified. In certain embodiments, the remaining brine solution from extraction step 520, from which the manganese and zinc have been removed, can then be reinjected into the geothermal well from which the brine was originally removed.

The acid solution from step 530 can then be extracted in extraction step 540 to recover manganese and zinc, as previously provided, to provide an extract solution that includes both manganese and zinc. The manganese in the extract solution can be oxidized in step 550 to produce manganese dioxide, which can then be separated by filtration or other known means in step 560. Zinc remaining in the extract solution can then be recovered in step 570 by electrochemical means, such as electrowinning or a like process. In certain embodiments, as shown by the dashed line, the solution from zinc electrochemical recovery step 570 can be recycled to the dissolution step 530.

Figure 6:
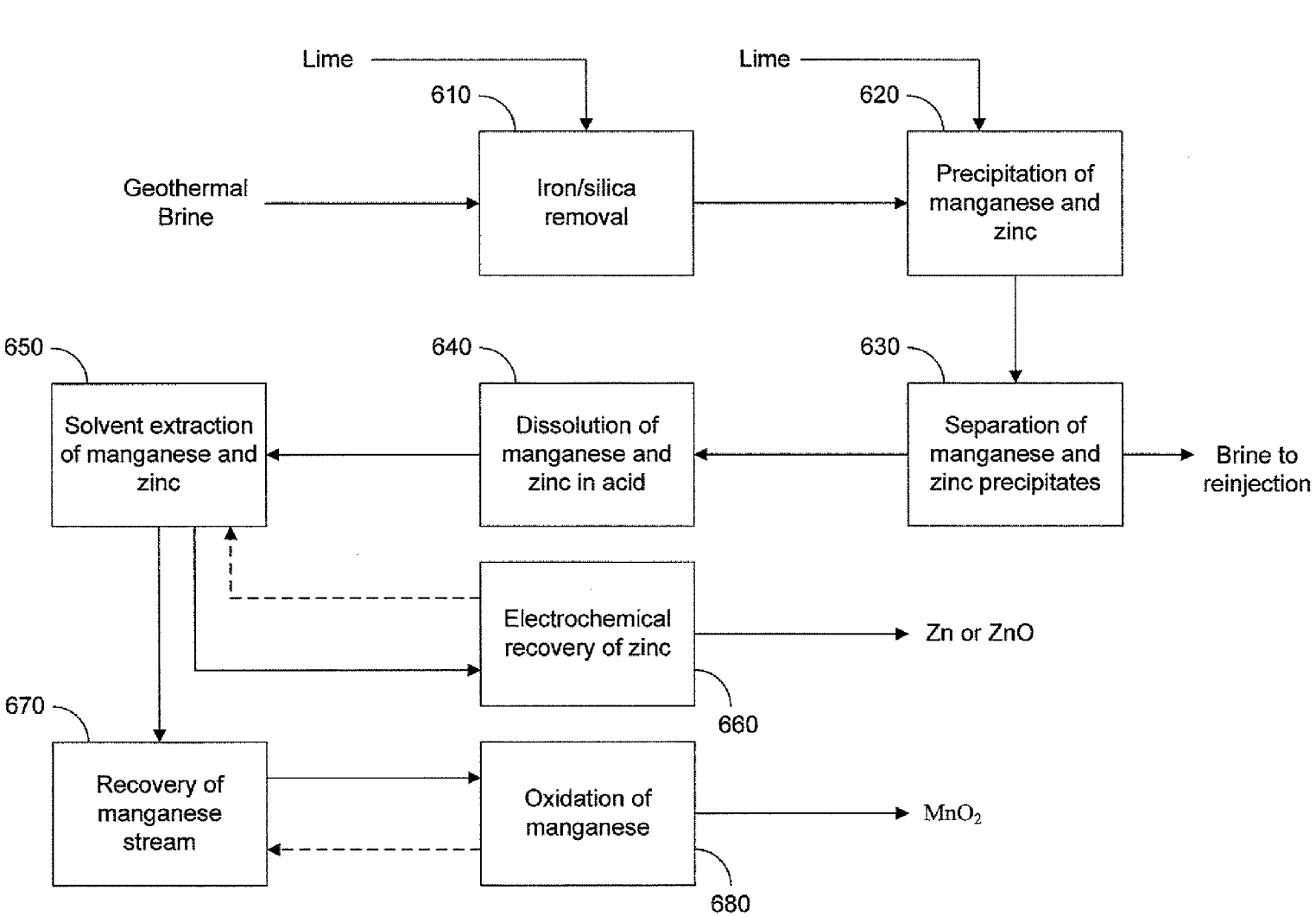
FIG. 6 illustrates another process for the recovery of manganese and zinc from a geothermal brine according to another embodiment of the invention.

In another embodiment, as provided in FIG. 6, process 600 for the recovery of manganese or zinc from a geothermal brine is provided. As previously discussed, first step 610 of the process includes the removal of iron and silica from the brine solution. In certain embodiments, the iron is oxidized and base is added to control the pH of the solution, preferably to at least about 5 and up to about 6. In certain embodiments, iron is oxidized with air and the base is calcium oxide or calcium hydroxide.

Following the removal of the iron and silica, in precipitation step 620, additional base is added to achieve a pH of at least about 6 to cause the precipitation of manganese and zinc. The manganese and zinc precipitates are collected by known means in step 630 and dissolved in an acid solution in step 640, as previously discussed herein. Optionally, the acid solution, which includes the manganese and zinc, can be purified. In certain embodiments, the remaining brine solution from extraction step 630, from which the manganese and zinc have been removed, can then be reinjected into the geothermal well from which the brine was originally removed.

The acid solution from step 640 is then subjected to a double extraction step 650, wherein the acid solution is contacted with two separate extraction solvents to recover two separate streams, wherein recovery step 670 recovers a first stream that includes manganese and a second stream is recovered includes zinc. Appropriate extraction solvents for the extraction of manganese and zinc have been previously discussed. The manganese in the first stream can be oxidized in oxidation step 680 to produce manganese dioxide, which is then separated by filtration or other known means. The zinc in the second stream can be recovered by electrochemical means, such as electrowinning, in step 660. As previously discussed, as shown by the dashed lines, following recovery of the zinc and manganese in steps 660 and 680, the respective solutions can be recycled to solvent extraction step 650 or to manganese stream recovery step 670, respectively.

Figure 7:
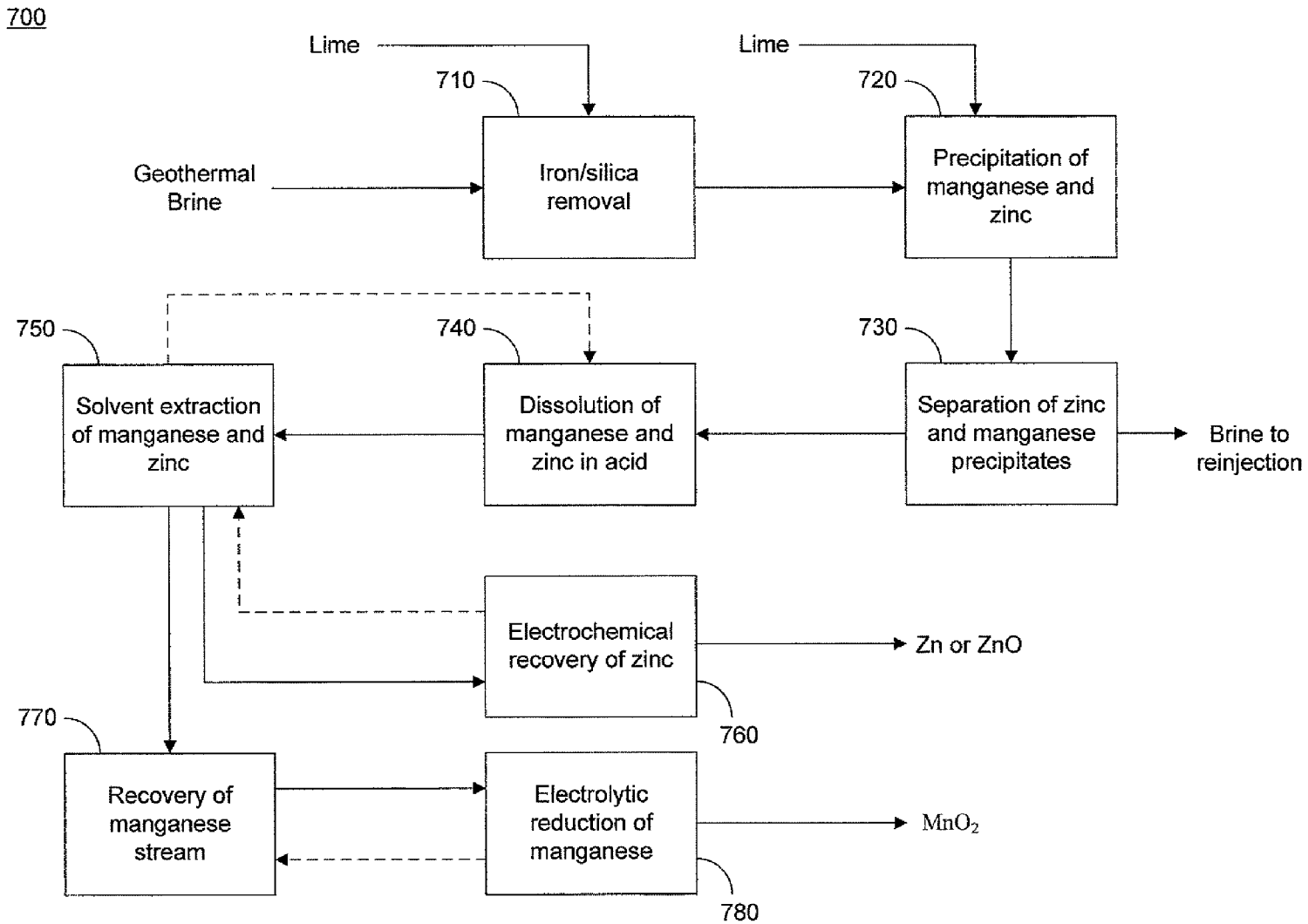
FIG. 7 illustrates another process for the recovery of manganese and zinc from a geothermal brine according to another embodiment of the invention.

In another embodiment, as provided in FIG. 7, process 700 for the recovery of manganese or zinc from a geothermal brine is provided. As previously discussed, a first step of the process includes the removal of iron and silica from the brine solution. In certain embodiments, the iron is oxidized and base is added to control the pH of the solution to about 5 and 6. In certain embodiments, iron is oxidized with air and the base is calcium oxide or calcium hydroxide.

Following the removal of the iron and silica, in precipitation step 720, additional base is added to achieve a pH of between about 6 and 9, preferably up to about 8 when sparged with air, or up to about 9 when it is not sparged with air, to facilitate the precipitation of manganese and zinc. The manganese and zinc precipitates are separated from a liquid phase in step 730, collected by known means, such as filtration, centrifugation or a like process, and dissolved in an acid solution in step 740, as previously discussed herein. Optionally, the acid solution, which includes the manganese and zinc, can be purified. In certain embodiments, the remaining brine solution from extraction step 730, from which the manganese and zinc have been removed, can then be reinjected into the geothermal well from which the brine was originally removed.

The acid solution from step 740 is then subjected to double extraction step 750, wherein the acid solution is contacted with two separate extraction solvents to recover two separate streams, wherein the first stream recovered in step 770 includes manganese, and wherein the second stream includes zinc. Appropriate extraction solvents for the extraction of manganese and zinc have been previously discussed. The manganese in the first stream can be electrolytically reduced in step 780, as is known in the art, to produce manganese metal. The zinc in the second stream can be recovered by electrochemical means in step 760, such as by electrowinning or a like process. As previously discussed, as shown by the dashed line, following recovery of the zinc and manganese in steps 760 and 780, the respective solutions can be recycled to the solvent extraction step 750 or to manganese stream recovery step 770, respectively. In certain embodiments, as shown by the dashed line, at least a portion of the non-extraction solvent solution from extraction step 750 can be recycled to dissolution step 740.

Figure 8:
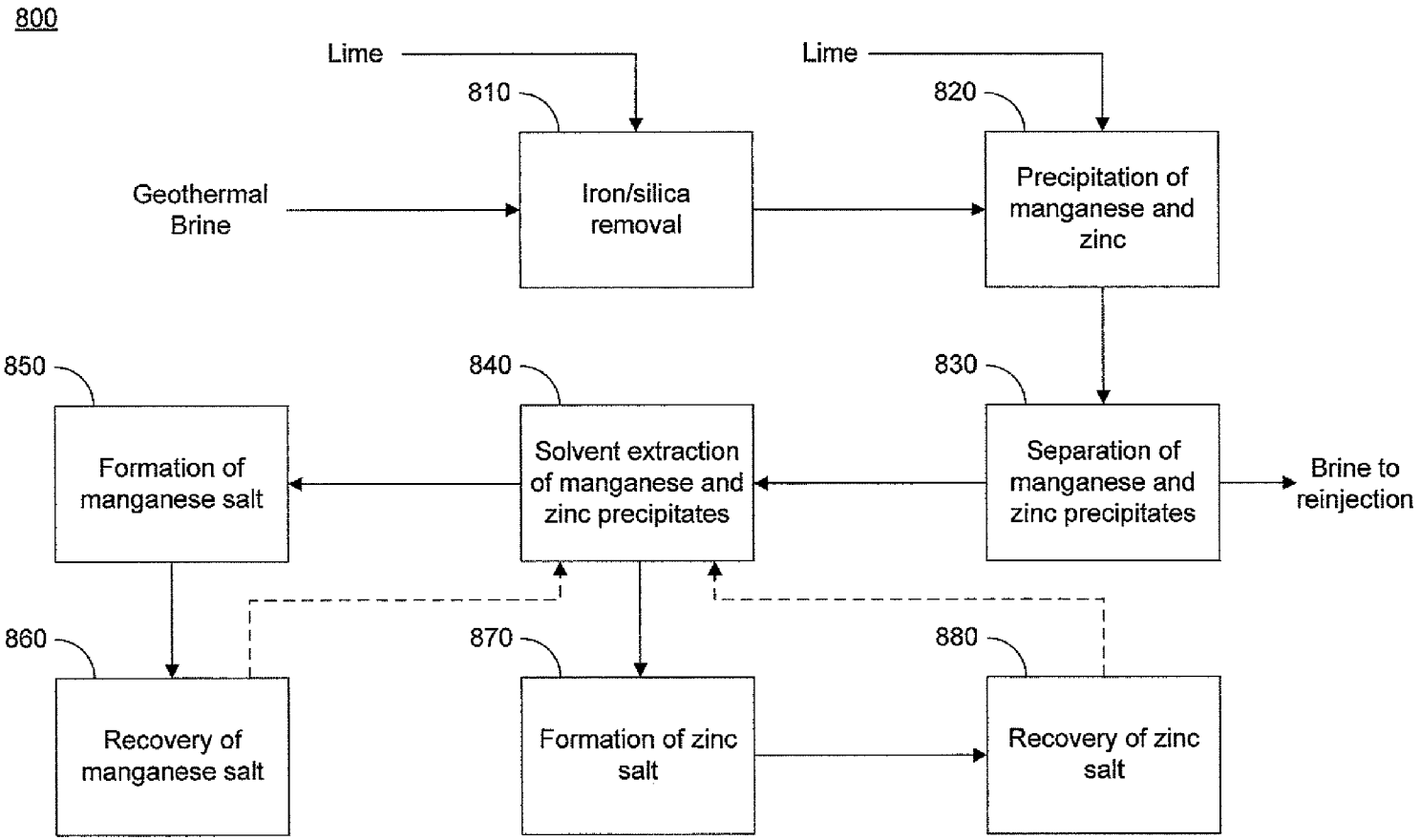
FIG. 8 illustrates another process for the recovery of manganese and zinc from a geothermal brine according to another embodiment of the invention.

In another embodiment, as provided in FIG. 8, process 800 for the recovery of manganese or zinc from a geothermal brine is provided. As previously discussed, a first step of the process includes the removal of iron and silica from the brine solution. In certain embodiments, the iron is oxidized and base is added to control the pH of the solution to between about 4.5 and 6, preferably between about 4.75 and 5.5. In certain embodiments, iron is oxidized with air and the base is calcium oxide or calcium hydroxide.

Following the removal of the iron and silica, in precipitation step 820, additional base is added to achieve a pH of between about 6 and 9, preferably up to about 8 when sparged with air, or up to about 9 when it is not sparged with air, to facilitate the precipitation of manganese and zinc. The manganese and zinc precipitates are separated and collected by known means in step 830, such as by filtration, centrifugation or a like process, and dissolved in an acid solution, as previously discussed herein. Optionally, the acid solution that includes the manganese and zinc can be purified. In certain embodiments, the remaining brine solution from extraction step 830, from which the manganese and zinc have been removed, can then be reinjected into the geothermal well from which the brine was originally removed.

The acid solution is then subjected to a double extraction in step 840, wherein the acid solution is contacted with two separate extraction solvents to recover two separate streams, wherein the first stream includes manganese and the second stream includes zinc. Appropriate extraction solvents for the extraction of manganese and zinc have been previously discussed. The manganese in the first stream can be reacted in step 850 with an acid, such as sulfuric acid, hydrochloric acid, hydrobromic acid, or a like acid to produce a manganese salt, which can then be recovered by precipitation in step 860. The zinc in the second stream can be recovered by electrochemical means, such as electrowinning or like means, or may also be reacted in step 870 with an acid, such as sulfuric acid, hydrochloric acid, hydrobromic acid, or a like acid to produce a salt solution and recovered in step 880 by precipitation, evaporative crystallization, spray drying, or a like process. As previously discussed, as shown by the dashed line, following recovery of the manganese and zinc salts in steps 860 and 880, the respective solutions can be recycled to solvent extraction step 840.

Figure 9:
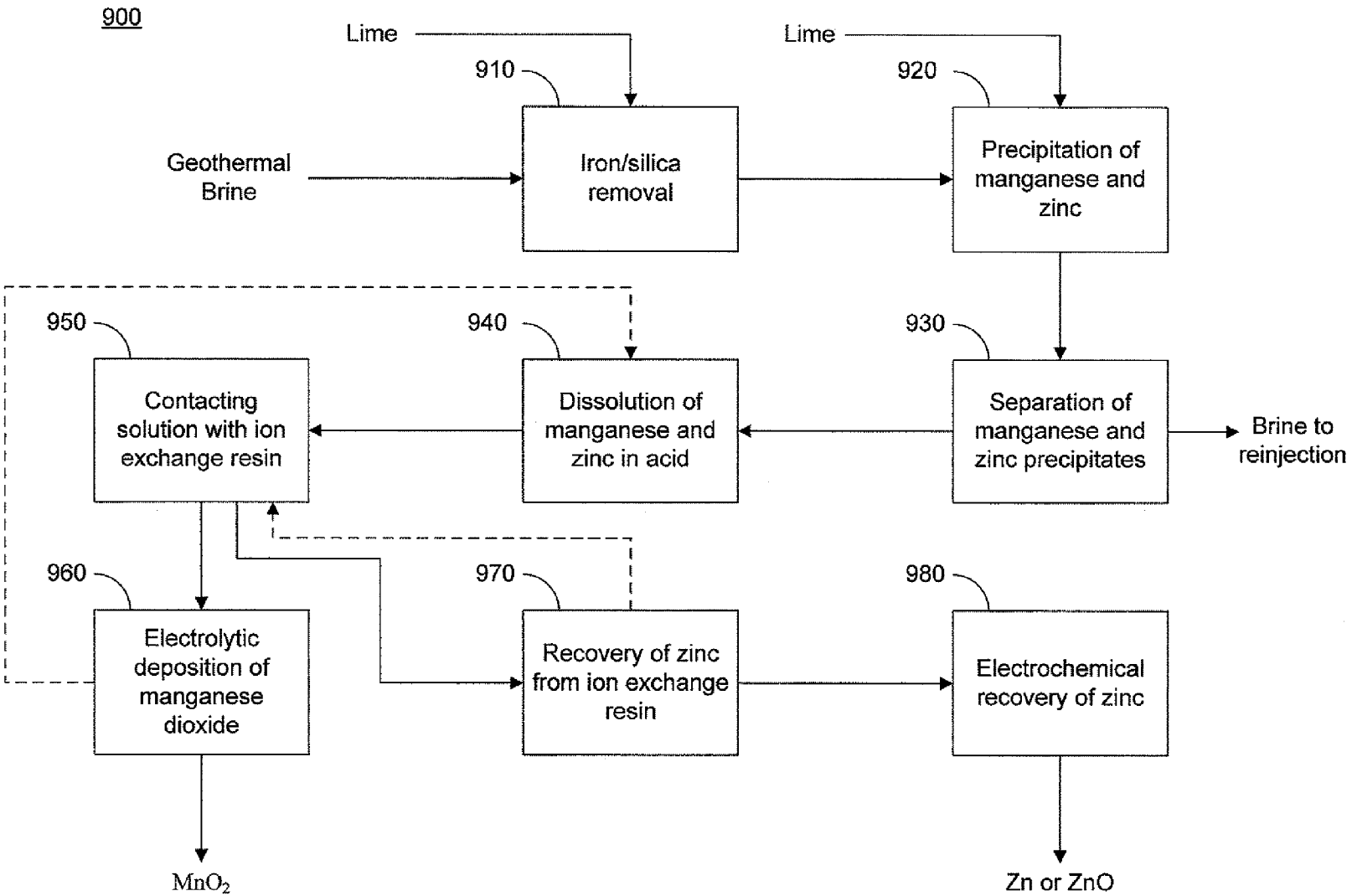
FIG. 9 illustrates another process for the recovery of manganese and zinc from a geothermal brine according to another embodiment of the invention.

In another embodiment, as shown in FIG. 9, process 900 for the recovery of manganese or zinc from a geothermal brine is provided. As previously discussed, first step 910 of the process includes the removal of iron and silica from the brine solution. In certain embodiments, the iron is oxidized and base is added to control the pH of the solution to between about 4.5 and 6, preferably between about 4.75 and 5.5. In certain embodiments, iron is oxidized with air and the base is calcium oxide or calcium hydroxide.

Following the removal of the iron and silica, in precipitation step 920 additional base is added to achieve a pH of between about 6 and 9, preferably up to about 8 when sparged with air, or up to about 9 when it is not sparged with air, to facilitate the precipitation of manganese and zinc. The manganese and zinc precipitates are separated in step 930, collected by known means and dissolved in an acid solution in step 940, as previously discussed herein. Optionally, the acid solution, which includes the manganese and zinc, can be purified, as previously discussed. In certain embodiments, the remaining brine solution from extraction step 930, from which the manganese and zinc have been removed, can then be reinjected into the geothermal well from which the brine was originally removed.

The acid solution is contacted with an ion exchange resin in step 950, preferably a basic anionic exchange resin, to remove zinc from the solution. In step 960, manganese can be recovered from the solution by electrolytically depositing manganese dioxide from the substantially silica free brine, such as by electrowinning or a like process. In step 970, zinc can then be recovered from the ion exchange resin by known means, and can be converted electrochemically in step 980 to zinc, and the zinc can then be converted to zinc oxide by known means. Optionally, as shown by the dashed line, following removal of the manganese in step 960, the remaining solution can be recycled to dissolution step 940. Similarly, as shown by the dashed line, following zinc recovery step 970, the remaining brine solution can be recycled to ion exchange resin contacting step 950.

In certain embodiments, an aqueous chloride solution is employed to wash zinc from the ion exchange resin, preferably having a chloride concentration of between about 0.5 and 5%. Optionally, multiple ion exchange resins can be employed. Optionally, at least a portion of a zinc solution produced by washing the ion exchange resin can be recycled to a prior stage of the process. In certain embodiments, the zinc solution produced by washing the ion exchange resin can be extracted with a solvent, wherein the solvent advantageously extracts zinc from the solution. Exemplary extraction solvents have been previously discussed, and can include D2EHPA or the like. Following removal of zinc from the ion exchange resin, a zinc-rich solution is obtained and zinc can then be recovered electrochemically from the zinc-rich solution.

Figure 10:
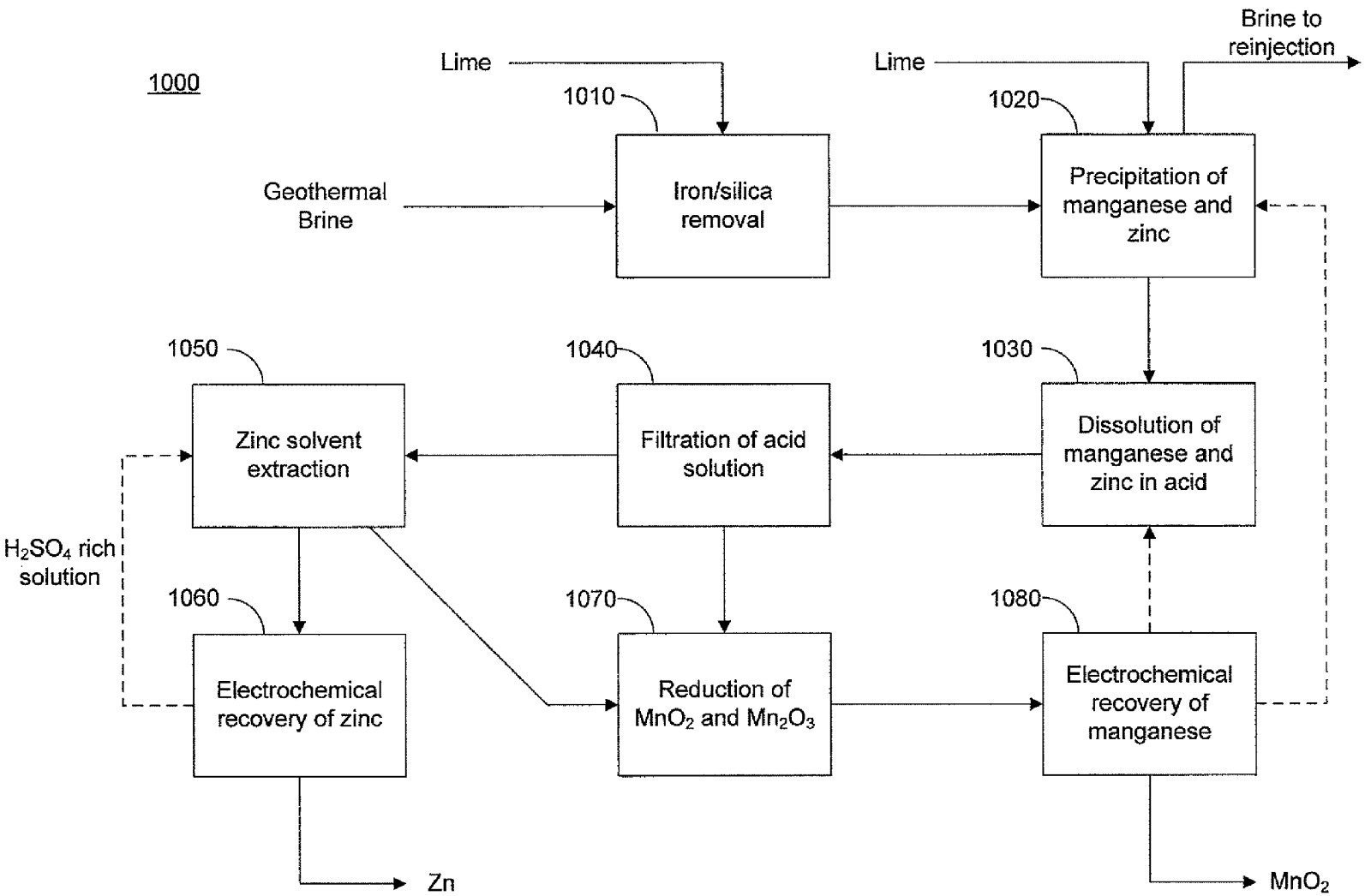
FIG. 10 illustrates another process for the recovery of manganese and zinc from a geothermal brine according to another embodiment of the invention.

Referring now to FIG. 10, in another aspect, a tenth process for the recovery of manganese and/or zinc from a geothermal brine is provided. First step 1010 of the process includes the removal of iron and silica from the brine solution, as previously described herein. In certain embodiments, the iron is oxidized and base is added to control the pH of the solution to between about 4.5 and 6, preferably between about 4.75 and 5.5. In certain embodiments, iron is oxidized with air and the base is calcium oxide or calcium hydroxide.

Following the removal of the iron and silica, in precipitation step 1020, additional base is added to cause the precipitation of manganese and zinc. The manganese and zinc precipitates are collected by known means and, in step 1030, dissolved in an acid solution, as previously discussed herein. Optionally, the acid solution that includes the manganese and zinc can be purified. In certain embodiments, the remaining brine solution from extraction step 1020, from which the manganese and zinc have been removed, can then be reinjected into the geothermal well from which the brine was originally removed.

The acid solution is filtered in step 1040 to produce a manganese containing solution and zinc precipitates. Zinc precipitates are electrochemically converted to zinc metal in step 1050. The solution is passed to zinc solvent extraction step 1060 to recovery remaining zinc. The manganese containing solution from the filtration step is provided to a reduction step 1070 wherein the manganese containing solution is contacted with a reducing agent, such as $SO_2$. In step 1080, the reduced manganese can be recovered from the solution by electrolytically depositing manganese dioxide, such as by electrowinning.

Optionally, as shown by the dashed line, following recovery of zinc in electrochemical recovery step 1060, a sulfuric acid-rich solution can be recycled to zinc extraction step 1050. Similarly, as shown by the dashed line, following the electrochemical recovery of manganese in step 1080, the remaining brine solution can be recycled to either precipitation step 1020 or dissolution step 1030.

Figure 11:
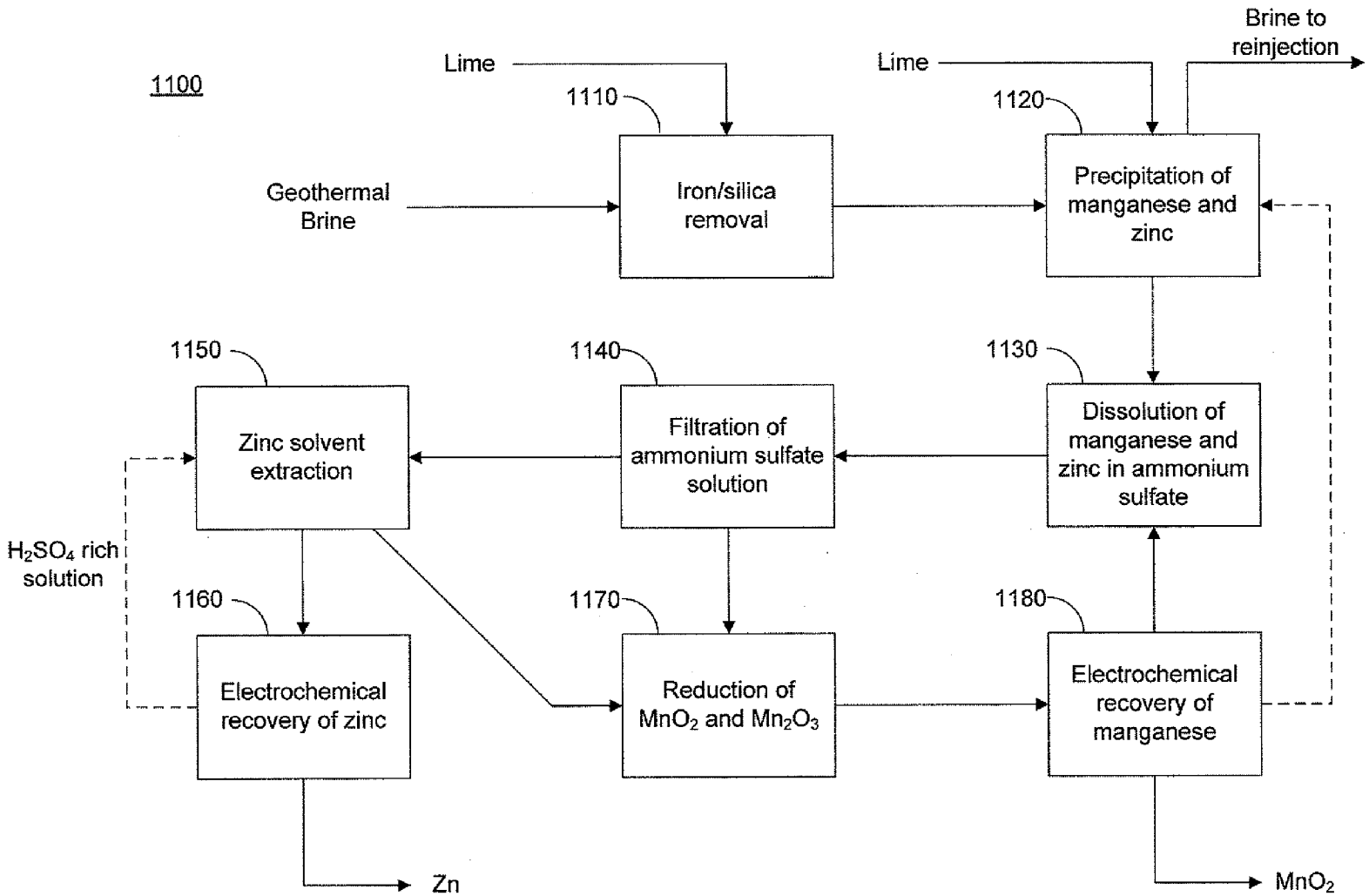
FIG. 11 illustrates another process for the recovery of manganese and zinc from a geothermal brine according to another embodiment of the invention.

Referring now to FIG. 11, in another aspect, a tenth process for the recovery of manganese and/or zinc from a geothermal brine is provided. First step 1110 of the process includes the removal of iron and silica from the brine solution, as previously described herein. In certain embodiments, the iron is oxidized and base is added to control the pH of the solution to between about 4.5 and 6, preferably between about 4.75 and 5.5. In certain embodiments, iron is oxidized with air and the base is calcium oxide or calcium hydroxide.

Following the removal of the iron and silica, in precipitation step 1120, additional base is added to cause the precipitation of manganese and zinc. The manganese and zinc precipitates are collected by known means and, in step 1130, dissolved in an ammonium sulfate solution. Optionally, the ammonium sulfate solution that includes the manganese and zinc can be purified. In certain embodiments, the remaining brine solution from extraction step 1020, from which the manganese and zinc have been removed, can then be reinjected into the geothermal well from which the brine was originally removed.

The ammonium sulfate solution is filtered in step 1040 to produce a manganese containing solution and zinc precipitates. Zinc precipitates are electrochemically converted to zinc metal in step 1050. The solution is passed to zinc solvent extraction step 1060 to recovery remaining zinc. The manganese containing solution from the filtration step is provided to a reduction step 1070 wherein the manganese containing solution is contacted with a reducing agent, such as $SO_2$. In step 1080, the reduced manganese can be recovered from the solution by electrolytically depositing manganese dioxide, such as by electrowinning.

Optionally, as shown by the dashed line, following recovery of zinc in electrochemical recovery step 1060, a sulfuric acid-rich solution can be recycled to zinc extraction step 1050. Similarly, as shown by the dashed line, following the electrochemical recovery of manganese in step 1080, the remaining brine solution can be recycled to either precipitation step 1020 or dissolution step 1030.

In certain embodiments of the present invention, as described herein, solid zinc oxide produced electrochemically or by ion exchange extraction can be dissolved in various acids for the production of zinc compounds. For example, in one embodiment, zinc oxide can be added to hydrochloric acid to form solid zinc chloride. The solid zinc chloride can then be separated by filtration. In certain embodiments, the zinc chloride can be isolated from solution by removing the liquid by evaporation, spray drying, or other known methods. In an alternate embodiment, zinc oxide can be added to hydrobromic acid to form zinc bromide. Alternatively, zinc oxide can be added to sulfuric acid to form zinc sulfate. Alternatively, zinc oxide can be added to methylsulfonic acid to form zinc methylsulfonate. In certain embodiments, to facilitate precipitation of the various zinc compounds, a portion of the solution can be evaporated, or the zinc compound can be separated by spray drying. In certain embodiments, recovered solid zinc compounds can be washed with minimal water and dried.

EXAMPLES

For testing purposes, a synthetic brine was employed for examples 1-3 having metal concentrations of approximately the following: 1600 mg/L Fe; 96 mg/L Si; 2500 mg/L Mn; 790 mg/L Zn; 290 mg/L Li; 41,000 mg/L Ca; 27,000 mg/L K; 85,500 mg/L Na; and 185 mg/L Sr.

Example 1

Approximately 1.22 L of the synthetic brine was placed in a 2 L reactor and maintained at a temperature of between about 90-95° C. and sparged with air at a rate of about 2.25 L/minute. The initial pH of the brine was about 4.89. To the reaction approximately 14 g of a 20% slurry of calcium hydroxide added. After addition of the slurry, a pH of about 2.85 was achieved, which gradually increased to approximately 3.56 after about 10 minutes. After 40 minutes, at which time the pH was about 2.9, approximately 5.33 g of a 20% slurry of calcium hydroxide was added, which raised the pH to about 4.07. The brine and the calcium hydroxide slurry were mixed for approximately 30 min, during which time the pH decreased to approximately 4.0, at which time approximately 21.22 g of the 20% slurry of calcium hydroxide was added. The addition of the calcium hydroxide slurry increased the pH to approximately 4.5. The mixture was stirred for about another 20 minutes, after which approximately 28.54 g of the calcium hydroxide slurry was again added, and the pH increased to approximately 5.18. The reaction was allowed to stir for an about additional 30 minutes, and the solid was collected and weighed. The solid includes approximately 99.6% of the iron present in the brine and approximately 99.9% of the silica. Additionally, approximately 492% of the manganese present in the brine was removed.

Example 2

Approximately 1.32 L of the synthetic brine was placed in a 2 L reactor and maintained at a temperature of between about 90-95° C. and sparged with air at a rate of about 2.25 L/minute. The reaction was stirred for approximately 60 minutes and the pH of the solution was monitored. After about 60 minutes, a pH of about 2.05 was achieved. To the brine solution was added approximately 9.73 g of a 20% slurry of calcium hydroxide, which raised the pH to about 5.4. The brine and the calcium hydroxide slurry were mixed for approximately 30 min, during which time the pH decreased to approximately 3.4, at which time approximately 2.56 g of the 20% slurry of calcium hydroxide was added. The addition of the slurry increased the pH to approximately 4.9. The mixture was stirred for about another 20 minutes, after which approximately 1.21 g of the calcium hydroxide slurry was again added, and the pH increased to approximately 5.3. The reaction was allowed to stir for about an additional 70 minutes, and the solid was collected and weighed. The solid includes approximately 98% of the iron present in the brine and approximately 99% of the silica. Additionally, approximately 2% of the manganese present in the brine was removed.

Example 3

Approximately 1.32 L of the synthetic brine was placed in a 2 L reactor and maintained at a temperature of between about 90-95° C. and sparged with air at a rate of about 2.25 L/minute. The reaction was stirred for approximately 60 minutes and the pH of the solution was monitored. After about 22 minutes, a pH of about 2.52 was achieved. To the brine solution was added approximately 9.7 g of a 20% slurry of calcium hydroxide, which raised the pH to about 5.56. The brine and the calcium hydroxide slurry were mixed for approximately 13 min, during which time the pH decreased to approximately 4.27, at which time approximately 1.9 g of the 20% slurry of calcium hydroxide was added. The addition of the calcium hydroxide slurry increased the pH to approximately 5.2. The mixture was stirred for about another 5 minutes, during which time the pH decreased to approximately 4.49. Approximately 2.25 g of the calcium hydroxide slurry was again added, and the pH increased to approximately 5.17. The reaction was allowed to stir for about an additional 110 minutes, during which time the pH was maintained at between about 5.13 and 5.17, and the solid was collected and weighed. The solid includes approximately 95.6% of the iron present in the brine and approximately 88.5% of the silica. Additionally, approximately 2% of the manganese present in the brine was removed.

Example 4

A synthetic brine having a composition that includes about 330 mg/L Li; 2400 mg/L Mn; 740 mg/L Zn; 40,000 mg/L Ca; 26,000 mg/L K; 91,000 mg/L Na; 180 mg/L Sr and 0.8 mg/L Fe was placed in a 2 L reactor and maintained at a temperature of between about 90-95° C. and sparged with air at a rate of about 2.25 L/minute. The initial pH was approximately 5.5. After sparging the reactor with air, a calcium hydroxide slurry was added sufficient to bring the pH to approximately 6.6. Additional calcium hydroxide slurry was added over about the next 180 minutes at various intervals. During the addition of the calcium hydroxide slurry, the pH increased from an initial value of about 6.6 to 8. A precipitate was collected which included zinc and manganese. The process recovered about 95.2% of the manganese present in the brine, about 94.6% of the zinc present in the brine, about 0.8% of the calcium present in the brine, and about 75% of the iron present in the brine. Due to the high recovery of iron by this process, the need for removal is confirmed.

Example 5

A synthetic brine having a composition that includes about 326 mg/L Li; 2640 mg/L Mn; 886 mg/L Zn; 41,000 mg/L Ca; 28,000 mg/L K; 84,000 mg/L Na; 180 mg/L Sr and 0.3 mg/L Fe was placed in a 2 L reactor and maintained at a temperature of between about 90-95° C. and sparged with air at a rate of about 2.25 L/minute. After sparging the reactor with air, a calcium hydroxide slurry was added in a single dosage sufficient that the pH of the brine solution was measured immediately after addition of the calcium hydroxide slurry and was about 7.6. During the stirring and sparging of the reaction, the pH increased from an initial value of about 7.6 to 7.9 after approximately 15 minutes, and then decreased gradually to about 7.5. A precipitate was collected which included zinc and manganese. The process recovered about 100% of the manganese present in the brine, about 99.9% of the zinc present in the brine, and about 8% of the lithium present in the brine.

As is understood in the art, not all equipment or apparatuses are shown in the figures. For example, one of skill in the art would recognize that various holding tanks and/or pumps may be employed in the present method.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these reference contradict the statements made herein.

As used herein, recitation of the term about and approximately with respect to a range of values should be interpreted to include both the upper and lower end of the recited range.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

We claim:

1. A method for recovering zinc and manganese from a geothermal brine, the method comprising the steps of:
- providing a geothermal brine, said geothermal brine comprising manganese and zinc;
- selectively removing silica and iron from the geothermal brine to produce a substantially silica free brine;
- adjusting the pH of the substantially silica free brine to a pH suitable to form precipitates of zinc and manganese, such that precipitates of zinc and manganese are selectively formed and other metal precipitates are not formed;
- separating the zinc and manganese precipitates from the brine;
- dissolving the precipitates of zinc and manganese to produce a zinc and manganese containing solution;
- extracting the zinc and manganese containing solution with an extraction solvent to produce a first liquid phase that includes the extraction solvent and zinc and a second liquid phase that includes manganese;
- separating the first and second liquid phases;
- electrochemically recovering zinc from the first liquid phase;
- reducing the second liquid phase to form $Mn^{2+}$;
- supplying the $Mn^{2+}$ to an electrochemical cell and recovering the manganese by electrochemical means.

2. The method of claim 1 wherein the precipitates of zinc and manganese are dissolved in an acid.

3. The method of claim 1 wherein the precipitates of zinc and manganese are dissolved in ammonium sulfate.

4. The method of claim 1 wherein the step of selectively removing silica and iron from the geothermal brine comprises providing iron (III) at a pH of between about 4.5 and 6 and precipitating the silica and iron from the brine.

5. The method of claim 1 wherein the step of precipitating the zinc and manganese comprises adding sufficient base to adjust the pH to between 6 and 8 and providing an air oxidant to the substantially silica free brine.

6. The method of claim 1 further comprising contacting the zinc with hydrochloric acid to produce zinc chloride.

7. A method for recovering zinc and manganese from a geothermal brine, the method comprising the steps of
- providing a geothermal brine, said geothermal brine comprising manganese and zinc;
- selectively removing silica and iron from the geothermal brine to produce a substantially silica free brine;
- adjusting the pH of the substantially silica free brine to a pH suitable to form precipitates of zinc and manganese, such that precipitates of zinc and manganese are selectively formed and other metal precipitates are not formed;
- separating the zinc and manganese precipitates from the brine;
- dissolving the precipitates of zinc and manganese to produce a zinc manganese solution;
- oxidizing the manganese to form a manganese precipitate and a zinc solution;
- separating the manganese precipitate from the zinc solution;
- recovering the zinc by electrochemical means.

8. The method of claim 7 wherein the step of selectively removing silica and iron from the geothermal brine comprises providing iron (III) at a pH of between about 4.5 and 6 and precipitating the silica and iron from the brine.

9. The method of claim 7 wherein the step of precipitating the zinc and manganese comprises adding sufficient base to adjust the pH to between 6 and 8 and providing an air oxidant to the substantially silica free brine.

10. The method of claim 7 wherein the step of dissolving the zinc and manganese comprises providing a mineral acid sufficient to dissolve the zinc and manganese precipitate.

11. The method of claim 7 wherein the step of recovering the zinc by electrochemical means comprises plating an electrode with zinc metal from the zinc solution.

12. A method for recovering zinc and manganese from a geothermal brine, the method comprising the steps of:
- providing a geothermal brine, said geothermal brine comprising manganese and zinc;
- selectively removing silica and iron from the geothermal brine to produce a substantially silica free brine that includes manganese and zinc;
- removing the zinc from the substantially silica free brine;
- extracting manganese from the substantially silica free brine;
- oxidizing the manganese to produce a manganese dioxide precipitate; and
- recovering the magnesium dioxide precipitate.

13. The method of claim 12 wherein the step of selectively removing silica and iron from the geothermal brine comprises providing iron (III) at a pH of between about 4.5 and 6 and precipitating the silica.

14. The method of claim 12 wherein the zinc is removed from the substantially silica free brine by ion exchange.

15. The method of claim 12 wherein the step of oxidizing the manganese to produce manganese dioxide comprises electrolytic deposition.

16. A method for recovering zinc and manganese from a geothermal brine, the method comprising the steps of
- providing a geothermal brine, said geothermal brine comprising manganese and zinc;
- selectively removing silica and iron from the geothermal brine to produce a substantially silica free brine that comprises manganese and zinc;
- extracting manganese and zinc from the substantially silica free brine to produce a manganese zinc solution;
- electrochemically removing manganese from the manganese zinc solution to produce a residual solution that includes zinc; and
- electrochemically removing zinc from the residual solution.

17. The method of claim 16 wherein the step of selectively removing silica and iron from the geothermal brine comprises providing iron (III) at a pH of between about 4.5 and 6 and precipitating the silica.

18. The method of claim 16 wherein the step extracting manganese and zinc from the substantially silica free brine comprises extracting the manganese and zinc with a solvent selected from the group consisting of phosphines, phosphoric acids, and phosphinic acids.

19. The method of claim 16 wherein the step of recovering the manganese by electrochemical means comprises plating an electrode with manganese metal from the manganese zinc solution.

20. The method of claim 16 wherein the step of electrochemically removing the zinc means comprises plating an electrode with zinc metal from the zinc solution.

* * * * *

UNITED STATES PATENT AND TRADEMARK OFFICE

CERTIFICATE OF CORRECTION

PATENT NO. : 8,454,816 B1
APPLICATION NO. : 12/880924
DATED : June 4, 2013
INVENTOR(S) : Stephen Harrison et al.

It is certified that error appears in the above-identified patent and that said Letters Patent is hereby corrected as shown below:

In the Claims

Claim 7.
Column 19, Line 49, add - : - after the word of

Claim 12.
Column 20, Line 27, delete “magnesium” and add - manganese -

Claim 16.
Column 20, Line 38, add - : - after the word of

Signed and Sealed this
Eighteenth Day of February, 2014

Michelle K. Lee

Michelle K. Lee
*Deputy Director of the United States Patent and Trademark Office*